US006896558B1

(12) United States Patent
Varis

(10) Patent No.: US 6,896,558 B1
(45) Date of Patent: May 24, 2005

(54) CONNECTOR AND CONTACT WAFER

(75) Inventor: Arvo Varis, Joensuu (FI)

(73) Assignee: Perlos Oyj, Vantaa (FI)

( * ) Notice: Subject to any disclaimer, the term of this patent is extended or adjusted under 35 U.S.C. 154(b) by 1 day.

(21) Appl. No.: 10/609,437

(22) Filed: Jul. 1, 2003

Related U.S. Application Data

(63) Continuation of application No. PCT/FI02/00103, filed on Feb. 11, 2002.

(30) Foreign Application Priority Data

Feb. 12, 2001 (FI) ..... 20010262

(51) Int. Cl.[7] ..... H01R 13/502
(52) U.S. Cl. ..... 439/701; 439/660
(58) Field of Search ..... 439/701, 660

(56) References Cited

U.S. PATENT DOCUMENTS 3,196,378 A * 7/1965 Beckwith ..... 439/701
4,927,388 A * 5/1990 Gutter ..... 439/660
5,108,313 A * 4/1992 Adams ..... 439/610
5,236,375 A * 8/1993 Kachlic ..... 439/607

* cited by examiner

*Primary Examiner*—Tho D. Ta
(74) *Attorney, Agent, or Firm*—Young & Thompson

(57) ABSTRACT

A connector and a contact wafer. The connector (1) comprises at least two wafers (7) and the contact arms (6) of at least two contacts (4) arranged in different wafers (7) is arranged in the same connector contact space (3). The connector wafer (7) is designed so as to allow simultaneous arrangement of the contact arm (6) of a contact (4) arranged in at least one other wafer (7) in the same connector (1) contact space (3).

9 Claims, 1 Drawing Sheet

CONNECTOR AND CONTACT WAFER

CROSS REFERENCE TO RELATED APPLICATIONS

This application is a Continuation of International Application PCT/FI02/00103 filed on 11 Feb. 2002, which designated the U.S. and was published under PCT Article 21(2) in English.

FIELD OF THE INVENTION

The invention relates to a connector which comprises a wafer, to which at least one contact comprising a contact arm is attached, and a connector body, which comprises at least one contact space, inside of which the contact arm is arranged and where the contact of a counter connector connects to the contact.

The invention further relates to a contact wafer which comprises at least one contact, whose contact arm can be arranged in a contact space provided in the connector body, the wafer being arrangeable parallel with at least one other wafer in the connector body.

BACKGROUND OF THE INVENTION

The connectors concerned are used particularly for transmitting electric current between circuit boards, transmitting signals and generally in applications which require fast data transmission and/or high signal frequency.

Connectors are attached to a circuit board by the 'Pin-in-Paste' method where paste is spread onto the circuit board and then the connector is positioned on the circuit board. The circuit board and its connectors and other components are put in a convection oven or in a similar heated and closed section of the assembly line. The circuit boards and the components thereon are heated by actively circulating hot air around the components and the circuit board. Thermal energy solders the contact pins of the connector to the circuit board.

It is known to assemble a connector from wafers which are typically produced by injection-moulding a plastic body around the contact pins of contacts arranged in one row one on top of another. A necessary number of contact pieces are assembled next to one another in the connector at hand, after which the contacts are placed inside the connector body. Wafers facilitate handling of small contacts, keep contacts pins at a correct distance from one another and also support one another. Thus connectors typically comprise several contacts which are arranged one on top of another and in parallel.

Usually contacts with a standard width are used in the male connectors of the above-mentioned connectors. Contacts are available in several widths and the width of the male connector to be used is selected according to the requirements set by the given application. Prior art female connectors correspondingly comprise a contact corresponding to each male connector, i.e. the electric current or signal of the male connector is transmitted through the connector via one female contact. The female contacts and wafers including them are designed according to the dimensions of the male contact concerned and thus it is necessary to produce a female contact and a wafer with corresponding measurements for each male contact with a different width. The production, storage, handling and management of numerous contacts of different widths and their wafers cause considerable costs.

SUMMARY OF THE INVENTION

The object of the present invention is to provide a connector and a contact wafer to avoid the above-mentioned disadvantages.

The connector of the invention is characterized in that the connector comprises at least two wafers and that the contact arms of at least two contacts arranged in different wafers are arranged in the same contact space.

The contact wafer of the invention is characterized in that the wafer is designed so as to allow simultaneous arrangement of the contact arm of a contact arranged in at least one other wafer in the same connector contact space.

The basic idea of the invention is that the connector comprises at least two wafers to which the contacts are attached and which are arranged in parallel in the connector body and that the contact arms of at least two different contacts arranged in different wafers are arranged in the same contact space.

An advantage of the invention is that as many similar wafers can be arranged in parallel as is required by the width of the given male connector. Thus it is unnecessary to produce, handle and manage several wafers of different widths, which reduces the production costs of connectors considerably.

BRIEF DESCRIPTION OF THE DRAWINGS

The invention will be described in greater detail in the accompanying drawings, in which.

DETAILED DESCRIPTION OF THE INVENTION

Figure 2:
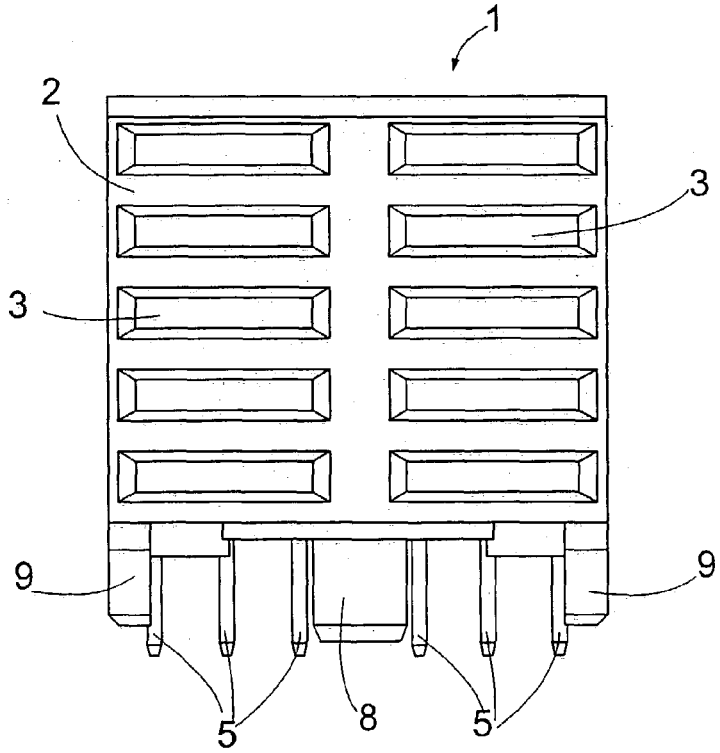
FIG. 2 is a partially cross-sectional and schematic front view of an embodiment of the connector according to the invention.

A connector body 2 comprises contact spaces 3, inside of which the contact arms 6 of contacts 4 are arranged. The connector body 2 is most often made of plastic by injection-moulding or pressing, for example. The contacts 4 are arranged one on top of another and in parallel in the connector body 2. Each of the contacts 4 arranged one on top of another is attached to the same wafer 7 in a manner known per se: in the embodiment of the invention shown in the figures there are six parallel contacts and thus the connector 1 includes six wafers 7. As is seen in FIG. 2, there are five contacts 4 one on top of another, in other words, each wafer 7 includes five contacts 4 and the whole connector 1 altogether 30 contacts 4. It should be noted here that the shape and dimensions of the details of the connector shown in the figures are only exemplary. The structure of the wafers 7 is very familiar to a person skilled in the art, for which reason it is not discussed in greater detail in this application. The contact 4 is made of a suitable conductive material, usually of a metal or a metal alloy. The wafers 7 are most often attached to the connector body 2 by providing the contact arms 6 with claw-like protrusions, which cling to the body 2 made of plastic.

Flat standard-sized male contacts of the other member of the connector pair, i.e. the male connector, which are not shown in the figures, are pushed into the contact spaces 3 of the connector 1 and thus they come into contact with the contact arms 6. In that case electric signals and/or supply current can be transmitted via the connector pair. Since in the embodiment shown each contact space 3 comprises three contact arms 6, the electric current or signal of one male connector contact is transmitted via three female contacts 4. Thus the wafer 7 is designed so as to allow arrangement of as many wafers in parallel as is required by the width of the counter connector in question. In the embodiments shown in the figures the contact arms 6 of the outermost contacts 4 are bent inwards closer to the middle contact arm 6 of the contact space 3. This ensures sufficient contact of the outermost contact arms 6 with the male contact. Bending of the contact arms 6 is a quick and simple operation which does not substantially increase the production costs of a connector. Naturally the contact arms 6 can also be shaped in some other manner known per se.

Figure 1:
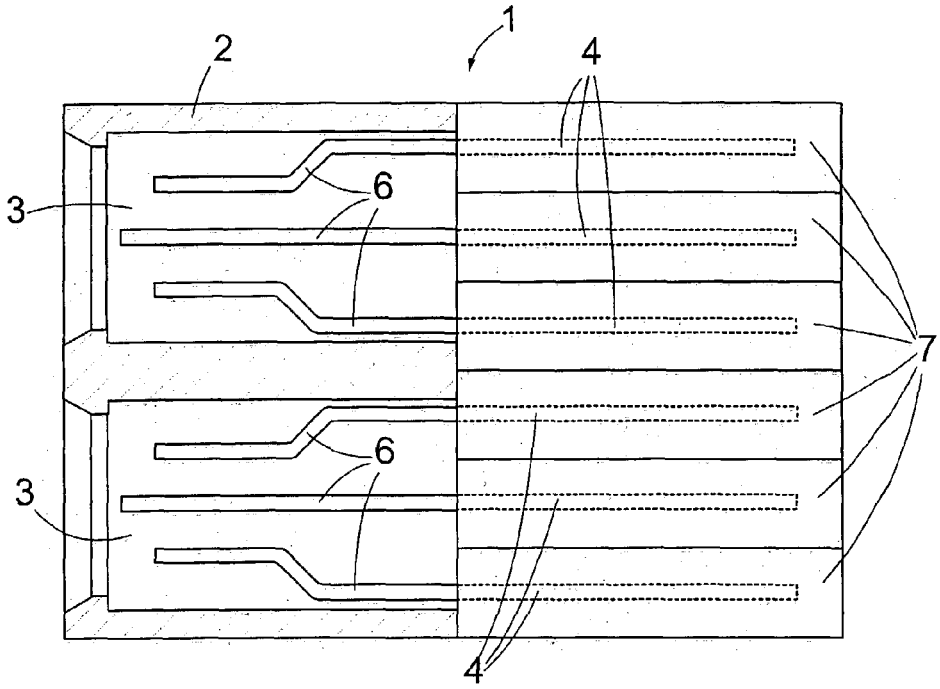
FIG. 1 is a partially cross-sectional and schematic top view of an embodiment of the connector according to the invention.

FIG. 2 is a schematic front view of the embodiment of the connector shown in FIG. 1. The contacts of the counter connector of the contacts are pushed into the connector contact spaces 3 from this direction. The connector 1 comprises five contact spaces 3 one on top of another in each of two parallel rows. The number of contact spaces 3 arranged one on top of another and in parallel can naturally differ from the one shown here. The contact spaces 3 are designed for a counter contact of a certain width, which is typically the standard width. Now the contact space 3 comprises contact arms 6 from three different wafers 7. The wafers 7 are designed so as to allow arrangement of as many of their contacts 4 in the same contact space 3 as is required by the width of the counter contact. The wafer 7 is similar regardless of the width of the counter contact. In that case the production and logistics costs of the wafer 7 and the production costs of the connector 3 are considerably lower than in prior art solutions, where a separate wafer is produced for each counter contact.

At one end of the contact 4 there is a contact pin 5, which is soldered to a circuit board or to another similar mounting plate intended to be connected to the connector 1. Often the connector body 2 is also soldered to the circuit board by means of a specific soldering board. At the bottom of the connector body 2 shown in the figure there is also a positioning pin 8, which positions the connector 1 to the right spot on its mounting plate; this part is not, however, always necessary. The connector 1 is also provided with coding parts 9 needed in its mechanical detection. Naturally the connector 1 may also comprise other functional parts which are not shown in the figures to simplify the illustration.

The drawings and the related description are only intended to illustrate the inventive concept. The details of the invention may vary within the claims. Thus the connector body 2 may comprise surfaces or elements inside the contact space 3 that support the contacts and in particular the contact arms 6. The number of contacts 4 arranged in the same contact space may also differ from three. Each contact space 3 in the connector 1 is not necessarily designed for a counter contact of equal width, neither is each contact space 3 necessarily provided with equal number of contacts 4.

What is claimed is:

1. A connector comprising:

a connector body having plural contact spaces therein;

at least two contacts each having a respective contact arm; and at least two wafers to which a respective one of said at least two contacts is attached, so that a respective contact arm of two different wafers is inside one of said plural contact spaces, wherein said at least two contacts are arranged one on top of another and said plural contact spaces are arranged one on top of another.

2. A connector according to claim 1, wherein all the contact arms in the same contact space are similar to one another.

3. A connector according to claim 1, wherein the same contact space comprises contact arms shaped in at least two different ways.

4. A connector according to claim 1, wherein the connector is a female connector.

5. A connector according to claim 1, wherein the connector is a signal connector.

6. A connector according to claim 1, wherein the connector is a current supply connector.

7. A connector according to claim 1, wherein all the contact arms in the same contact space are similar to one another.

8. A connector according to claim 1, wherein the same contact space comprises contact arms shaped in at least two different ways.

9. A contact wafer comprising:

at least one contact having a contact arm arrangeable in a contact space provided in a connector body, said contact wafer being arrangeable parallel with at least one other wafer in the connector body, so that a contact arm of a contact arranged in said at least one other wafer is simultaneously arranged in a same connector contact space with said contact arm of said contact wafer, wherein there are at least two contacts arranged one on top of another and attached to a respective wafer, and wherein the connector body is provided with plural contact spaces arranged one on top of another.

* * * * *